US006236136B1

(12) United States Patent
Hockaday et al.

(10) Patent No.: US 6,236,136 B1
(45) **Date of Patent: *May 22, 2001**

(54) METHODS AND RESULTS OF MANUFACTURING COMMUTATORS

(75) Inventors: Shepard L. Hockaday, Benson; Alvin Leon Farthing, Roseboro; Tony Earl Hall, Benson; John David Reece, Jr., Erwin, all of NC (US)

(73) Assignee: Morganite Incorporated, Dunn, NC (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/259,518

(22) Filed: Feb. 26, 1999

(51) Int. Cl.[7] ..... H01R 39/06

(52) U.S. Cl. ..... 310/233; 310/235; 310/236; 310/237; 29/597

(58) Field of Search ..... 310/235, 236, 310/237, 238, 233; 29/596, 597, 598; 264/272.19, 272.2

(56) References Cited

U.S. PATENT DOCUMENTS

| | | | | |
|---|---|---|---|---|
| Re. 36,248 | | 7/1999 | Farago et al. | 310/237 |
| 4,912,352 | | 3/1990 | Isozumi et al. | 310/233 |
| 5,153,979 | | 10/1992 | Terada | 29/597 |
| 5,157,299 | * | 10/1992 | Gerlach | 310/237 |
| 5,386,167 | | 1/1995 | Strobi | 310/237 |
| 5,491,373 | | 2/1996 | Copper et al. | 310/237 |
| 5,552,652 | * | 9/1996 | Shimoyama et al. | 310/237 |
| 5,629,576 | | 5/1997 | Shimoyama | 310/237 |
| 5,637,944 | | 6/1997 | Shimoyama | 310/237 |
| 5,677,588 | * | 10/1997 | Strobl | 310/237 |
| 5,760,518 | | 6/1998 | Abe et al. | 310/237 |
| 5,793,140 | * | 8/1998 | Tuckey | 310/237 |
| 5,826,324 | | 10/1998 | Abe et al. | 310/237 |
| 5,925,961 | * | 6/1999 | Sugiyanma | 310/237 |
| 5,955,812 | * | 9/1999 | Warner | 310/233 |
| 5,962,946 | * | 10/1999 | Kobmann et al. | 310/233 |
| 5,996,210 | | 12/1999 | Konig | 29/597 |

FOREIGN PATENT DOCUMENTS

| | | | |
|---|---|---|---|
| 2444846 | 4/1976 | (DE) | H01R/39/46 |
| 4026951 | 2/1992 | (DE) | H01R/39/06 |
| 19713936 | 11/1997 | (DE) | H01R/39/04 |
| 0583892 | 2/1994 | (EP) | H01R/39/06 |
| 0667657 | 8/1995 | (EP) | H01R/39/06 |
| 2358036 | 2/1973 | (FR) | H01R/39/04 |
| 2633781 | 1/1990 | (FR) | H01R/39/06 |
| WO99/18637 | 4/1999 | (WO) | H01R/39/06 |

* cited by examiner

*Primary Examiner*—Nestor Ramirez
*Assistant Examiner*—B Mullins
(74) *Attorney, Agent, or Firm*—Dean W. Russell; Kilpatrick Stockton LLP

(57) ABSTRACT

Addressed herein are commutators and methods of manufacturing them. The methods permit the carbonaceous material and core of a commutator to be molded simultaneously, rather than in a two-step process, and can eliminate one of two curing procedures used in connection with other manufacturing techniques. The necessity of machining the inner surface of the commutator shell to remove undesired excess phenolic or other material additionally is avoided by use of the techniques detailed herein. Commutators formed according to these methods may have increased useful lives and provide better performance than others presently available.

21 Claims, 4 Drawing Sheets

METHODS AND RESULTS OF MANUFACTURING COMMUTATORS

FIELD OF THE INVENTION

This invention relates to rotary switches and more particularly, although not exclusively, to "flat" or "face-style" commutators for use with electric motors and methods of manufacturing such commutators.

BACKGROUND OF THE INVENTION

U.S. Pat. No. 5,491,373 to Cooper, et al., incorporated herein in its entirety by this reference, discloses an exemplary high-speed rotary switch or commutator. Denoted a "barrel-style" device, the commutator illustrated in the Cooper, et al. patent includes multiple electrically-conductive segments arranged into a cylinder on the outer diameter of a non-conductive core. An electrical brush passes along the outer diameter of the core to form a conductive path with the one or more segments in contact with it at any given instant.

Described in U.S. Pat. Nos. 5,760,518 and 5,826,324 to Abe, et al. (also incorporated herein in their entireties by this reference) is a commutator whose face, rather than outer diameter or edge, conducts electricity. This face-style commutator is an alternative to a barrel-style device and is often used in devices exposed to corrosive environments or immersed in fuel. FIGS. 1 and 2 of the Abe, et al. patents illustrate aspects of such a commutator, with electrically-conductive segments 3 consisting principally of graphite.

Also shown in FIG. 2 of the Abe, et al. patents is metal shell or plate 5, whose terminal 6 admits connection to windings of a motor, and an electrically-insulating support 1. Plate 5 includes on its inner surface "small projections 7," which function to anchor the graphite segments 3 from displacement as the commutator operates. According to the Abe, et al. patents, a separate, unillustrated "part of . . . metal plate 5 is embedded in the electrically insulating support 1" to retain the relative positions of the plate and support.

Listed on the faces of the Abe, et al. patents as their assignee is Aupac Co., Ltd. ("Aupac"). A commutator made by Aupac includes two sets of anchors in the plate or shell. One set, analogous to the unshown portions of metal plate 5 discussed in the Abe, et al. patents, retains the position of the insulating support or core of the commutator, while the other (analogous to "small projections 7") assists in anchoring the conductive segments relative to the plate or shell. However, unlike projections 7 of the Abe, et al. patents, which extend radially inward from an inner surface of the plate or shell, the analogous anchors of the Aupac commutator are formed by bending radially inward axially-extending protrusions on an edge of the plate or shell (rather than as protrusions from its side).

FIGS. 1–6 illustrate, essentially identically, aspects of the Aupac commutator 100. Detailed in FIGS. 1–3 is metal shell 104 in which anchors 108 are formed. Such anchors 108 extend radially inward from shell 104 and are used to moor an electrically-insulating core 110 (see FIG. 4). Also shown in FIGS. 1–3 are terminals 112 (which ultimately will be bent into tangs or hooks) and projections 116. As noted in the preceding paragraph, projections 116 are not formed in inner surface 120 of shell 104 but rather extend from its edge 124 before being bent inward.

Manufacture of the Aupac commutator 100 is relatively complex. Initially, shell 104 must be blanked and formed in the manner of FIGS. 1–3 so as to create anchors 108, terminals 112, and projections 116. Core 110 must then be molded into shell 104, as shown in FIG. 4, so that its phenolic material surrounds anchors 108. Molding core 110 in this manner effectively embeds anchors 108 therein, helping fix the position of core 110 relative to shell 104.

After the phenolic material of core 110 is molded and cured, excess material (typically denoted "flash") must be removed from inner surface 120. Failure to remove such excess material can be problematic, as it can adversely affect the electrical continuity between shell 104 and the electrically-conductive graphite segments 126 (see FIG. 6) ultimately forming the face of the Aupac commutator 100. Machining, furthermore, is required to delete flash from inner surface 120 once core 110 has been molded and cured.

After the material of core 110 is cured and the flash is removed from inner surface 120 of shell 104, projections 116 must be bent radially inward as illustrated in FIG. 5. Concurrently terminals 112 may be formed into tangs or hooks 128 for subsequent attachment to the windings of a motor. Only then are conductive segments 126 created as shown in FIG. 6.

Included in FIG. 6 are the segments 126, which initially consist of graphite powder or material. The material is molded, or pressed, into recess 132 (see FIG. 5) so that it abuts core 110 and projections 116 are embedded within. Doing so anchors the material of segments 126 to shell 104, after which the material is cured and slotted to form the segments 126.

Surface 136 contacts electrical brushes, and thereby wears, in use. As is readily visible in FIG. 6, a substantial portion of each segment 126 lies further from surface 136 than projections 116 (and thus is not within the depth $D_2$ shown in that figure). It hence is unavailable as a contact surface, resulting in significant waste of the graphite material.

Moreover, to applicants' knowledge, at no time does shell 104 of the Aupac commutator 100 extend beyond surface 136. Shell 104 indeed cannot readily do so, as projections 116 must be bent inward in order to be embedded within segments 126. Similarly, neither commutator of the Abe, et al. patents contemplates having a plate 5 extending at any time above the exposed face of the carbonaceous material. Even though theoretically not impossible to extend plates 5 (upward as oriented in FIGS. 2 and 3 of the Abe, et al. patents) beyond pieces 3, no basis for such extension appears in the Abe, et al. patents.

SUMMARY OF THE INVENTION

Manufacturing methods of the present invention are substantially simpler than those used to produce both the Aupac commutator and those of the Abe, et al. patents. Unlike those utilized to create the Aupac commutator, for example, the methods employed with the present invention reverse the sequence of inserting a carbonaceous (typically at least slightly deformable) pre-form and (phenolic or other) insulating core into the commutator shell. As a consequence, the carbonaceous material and core can be molded simultaneously rather than in the two-step process described in the preceding section.

Methods of the present invention likewise eliminate one of two curing procedures involved in manufacturing the Aupac commutator. Because the insulating core of the Aupac commutator forms a base against which the carbonaceous material is forced under pressure, the core must be cured prior to molding of the carbonaceous material. Otherwise, the core will lack sufficient strength and rigidity to admit proper molding of the carbon segments as it encounters such pressure. With the present invention, however, curing of the carbonaceous material and core can occur simultaneously.

The necessity of machining the inner surface of the commutator shell to remove flash additionally is avoided by use of the present techniques. By having the annular (or otherwise-shaped) carbonaceous pre-form inserted into the shell prior to molding the insulating core, these techniques allow the pressure caused by the molding of the core to force the material of the pre-form outward so that it abuts the inner surface of the shell. This action prevents the core material from migrating to the inner surface of the shell and becoming undesired flash.

Noted in the preceding section are the two sets of anchors required for making the Aupac commutator. Although commutators of the present invention similarly may be made with two (or more) sets of anchors, only one set is necessary, as such set is adapted not only to secure both the core and carbonaceous material to the shell, but also to provide electrical continuity between the shell and carbonaceous material. Whereas the core of the Aupac commutator is already cured (and nonreactive) when the carbonaceous material is molded and thus no chemical bonding of the two substances occurs, the core and carbon pre-forms of the commutators of the present invention bond, or interlock, both chemically and mechanically as their simultaneous molding transpires. The result is increased mooring of the carbonaceous material to the core within the shell without the need to form additional anchors in the shell itself.

Avoiding projections 116 of the Aupac commutator enhances the useful lives of commutators of the present invention. By permitting use of essentially the entirety of their electrically-conductive segments, commutators according to the present invention likewise reduce waste of carbonaceous material. These commutators further are formed so that the molding of the carbonaceous material produces higher density, more uniform material, advantageous properties for many of their intended uses.

Commutators of the invention also may have shells of extended height during part or all of the manufacturing process. Increasing the height of the shell protects the integrity of the carbonaceous (or other) face material of each device, reducing its exposure to being chipped, scratched, or otherwise damaged during manufacture. The shell can be sheared at the end of the manufacturing process if desired so as not to protrude, or to protrude only a selected amount, beyond the commutator face.

It is therefore an object of the invention to provide an anchoring system for one or more conductive segments of a rotary switch or commutator.

It is also an object of the present invention to provide such a system which permits use of the commutator until the segments are substantially completely worn.

It further is an object of the present invention to provide methods of forming commutators in which either or both of the processes of molding and curing the core and carbonaceous material can occur simultaneously.

It additionally is an object of the present invention to provide methods of forming commutators in which unwanted insulating material of the core (i.e. flash) is either not deposited, or deposited in reduced amounts, on the interior surface of the shell.

It is, moreover, an object of the present invention to provide commutators having improved characteristics and longer useful lives than at least certain other commutators discussed herein.

It is an additional object of the present invention to provide a commutator whose expense and difficulty of manufacture is decreased and whose shell may extend beyond the face of the segments during at least part of the manufacturing process.

Other objects, features, and advantages of the present invention will be apparent with reference to the remainder of the text and to the drawings of this application.

DETAILED DESCRIPTION

Figure 7:
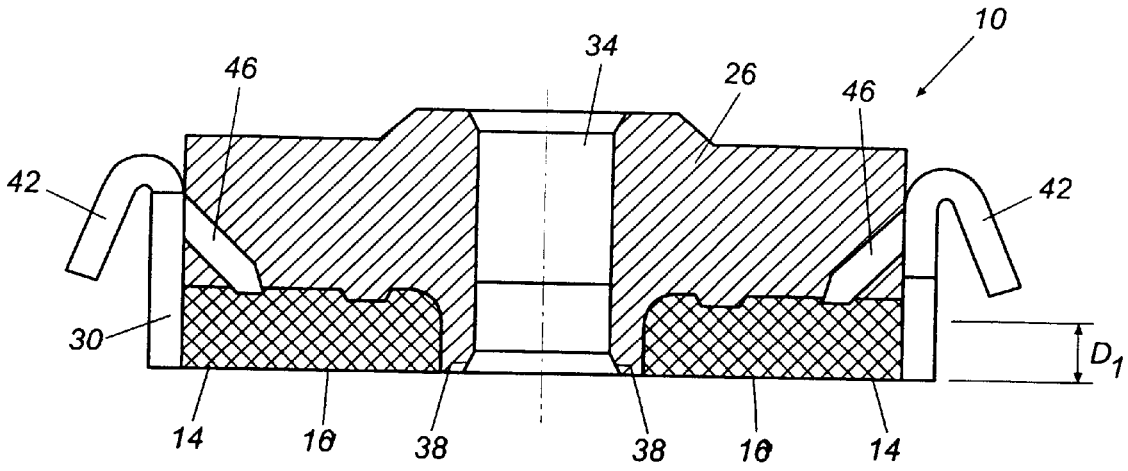
FIG. 7 is a cross-sectional view of a commutator of the present invention.

FIG. 7 provides a cross-sectional view of an exemplary commutator 10 of the present invention. Commutator 10 includes multiple conductive segments 14, whose exposed surfaces 18 are intended to contact one or more conductive brushes in use. Intermediate adjacent segments 14 are gaps or slots (not illustrated), which isolate the adjacent segments 14 and permit commutator 10 to operate as a high-speed rotary switch.

Also shown in FIG. 7 are core 26 and "blank" or shell 30. Core 26 is made of electrically-insulating material, typically (although not necessarily) phenolic, and defines a central aperture 34 for receiving a spindle or shaft in use. Core 26 additionally defines collar 38, which circumscribes aperture 34 in the area of segments 14.

Figure 8:
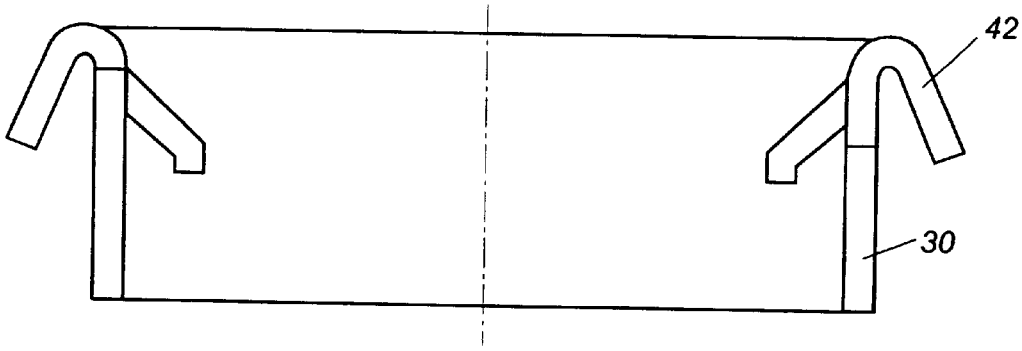
FIGS. 8–10 are cross-sectional views of the commutator of FIG. 7 illustrating aspects of its formation.

Usually manufactured from a curled strip of copper or other suitable metal, shell 30 constitutes the outer diameter of commutator 10. Formed into shell 30 are multiple tangs 42, which may be bent into hooks. Additionally included in shell 30 are internal anchors 46. As shown in FIG. 8, both tangs 42 and anchors 46 typically are formed following the blanking of shell 30.

Figure 9:
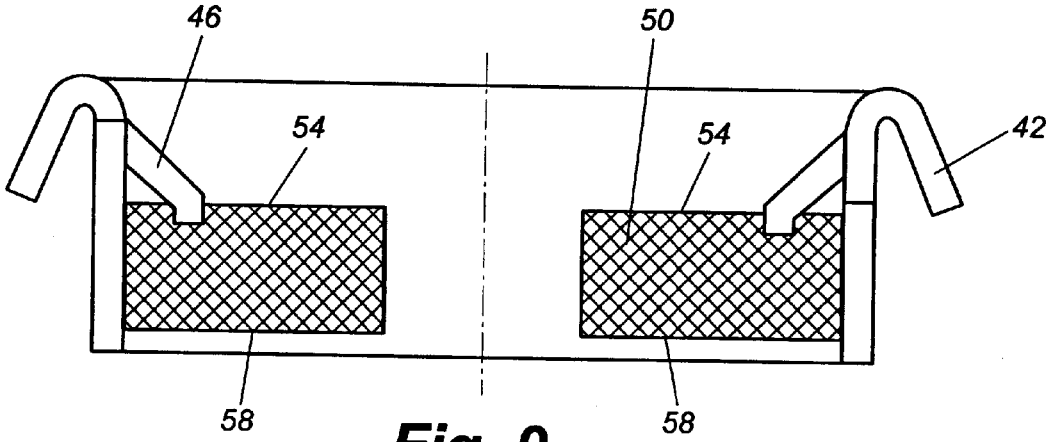

Thereafter, pre-form 50 (which may, but need not necessarily, be deformable) for segments 14 may be placed within shell 30. Consistent with FIG. 9, pre-form 50 may be inserted so that its inner face 54 is penetrated by anchors 46, thereby at least partially securing it in position within shell 30. Contact between anchors 46 and inner face 54 additionally provides further electrical connection between shell 30 and the pre-form 50. As shown in FIG. 9, shell 30 may extend beyond outer face 58 of pre-form 50, thereby protecting it to some extent during the remainder of the manufacturing process.

Although anchors 46 are shown as extending at an acute angle from shell 30, those skilled in the art will recognize that anchors 46 may be shaped or positioned differently if appropriate or desired. Anchors 46 additionally need not necessarily penetrate pre-form 50 if other securing mechanisms are adequate, but rather may instead merely abut or otherwise contact it. Likewise, shell 30 is not required to extend beyond outer faces 58, notwithstanding the advantages obtained when such extension exists.

Following placement of pre-form 50 within shell 30, the material of core 26 is injected and molded onto pre-form 50. The act of such molding, illustrated in FIG. 10, embeds portions of anchors 46 within core 26, thereby securing its position relative to shell 30. The high pressures and temperatures used to mold core 26 likewise concurrently mold pre-form 50, bonding core 26 to inner face 54 (typically via bonding of resins contained in both core 26 and pre-form 50) and mechanically interlocking features (i.e. protrusions and cavities represented diagrammatically in FIG. 10) on their adjoining surfaces (or possibly created by at least slight deformation of either or both components during the molding process). This chemical bonding and mechanical interlock between core 26 and pre-form 50 functions further to anchor pre-form 50 within shell 30.

Figure 10:
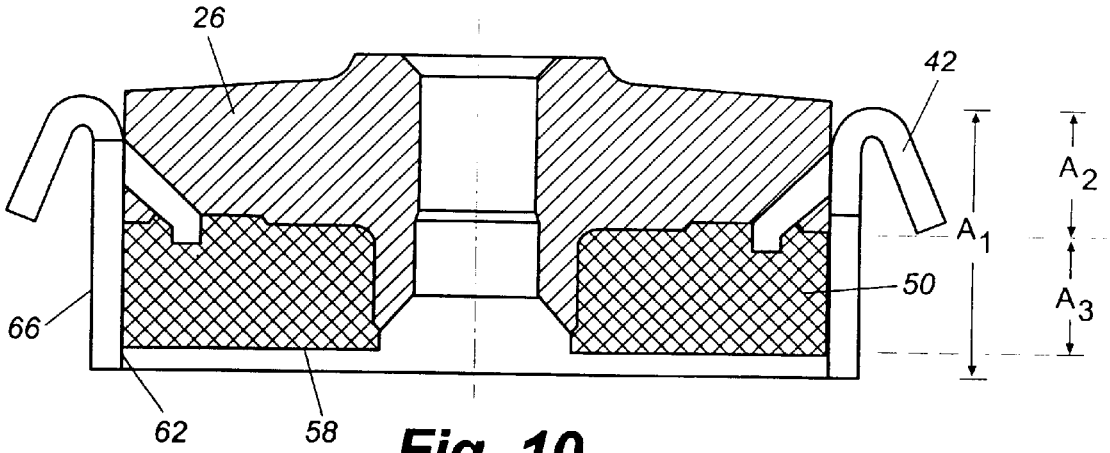

FIGS. 9–10 additionally illustrate the flash-avoidance aspects of the present invention. Because pre-form 50 is inserted into shell 30 before core 26 is molded, the pressure used to mold core 26 forces the material of pre-form 50 to expand outward against the inner surface 62 of shell 30. This expansion prevents excess material of core 26 from coming between pre-form 50 and inner surface 62, thus both preventing flash within shell 30 and avoiding any need to remove it. Further anchoring of preform 50 conceivably could occur if inner surface 62 contains a recess into which a portion of pre-form 50 could be fitted (or protrude when deformed).

To the extent any flash exists on outer surface 66 of shell 30, it can be removed using conventional mechanical-abrasion (or other) methods. As denoted in FIG. 10, height $A_1$ is greater than the sum of the depth $A_2$ to which core 26 is positioned within shell 30 and the height $A_3$ of pre-form 50. If shell 30 is abraded mechanically, its added height can advantageously protect outer face 58 from certain types of damage associated with such abrasion. Thereafter the material of both core 26 and pre-form 50 can be cured together and any added height of shell 30 (as well as the outermost layer of outer face 58) removed. Slotting additionally can occur to create segments 14, with contact surfaces 18, from pre-form 50.

Figure 1:
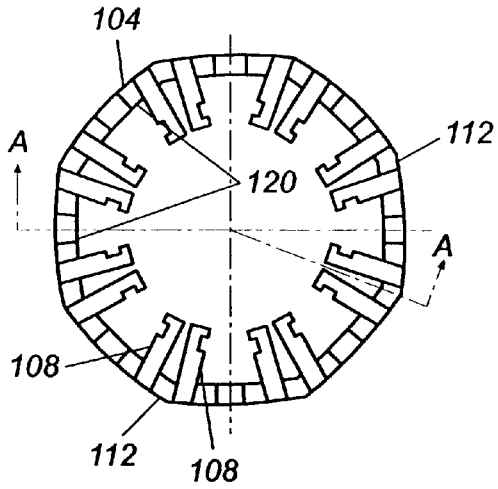
Fig. 1 PRIOR ART
FIG. 1 is a plan view of, essentially, the shell of the Aupac commutator.
Figure 2:
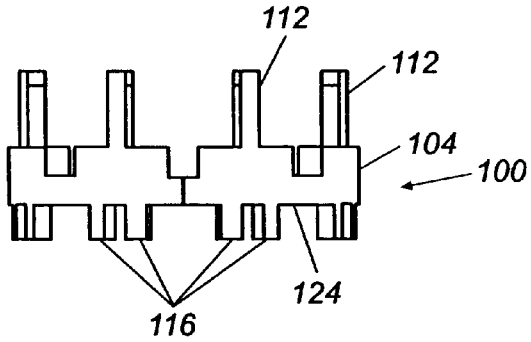
Fig. 2 PRIOR ART
FIG. 2 is an elevational view of the shell of the Aupac commutator of FIG. 1.
Figure 3:
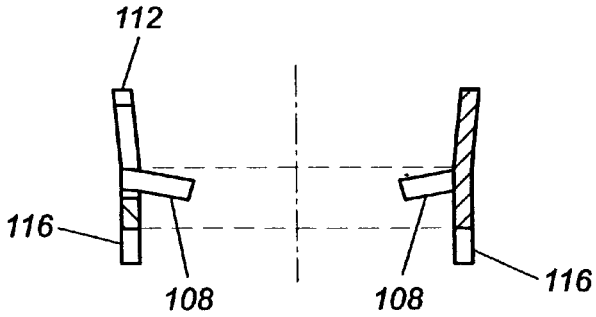
Fig. 3 PRIOR ART
FIG. 3 is a cross-sectional view of the shell of the Aupac commutator taken along lines A—A of FIG. 1.
Figure 4:
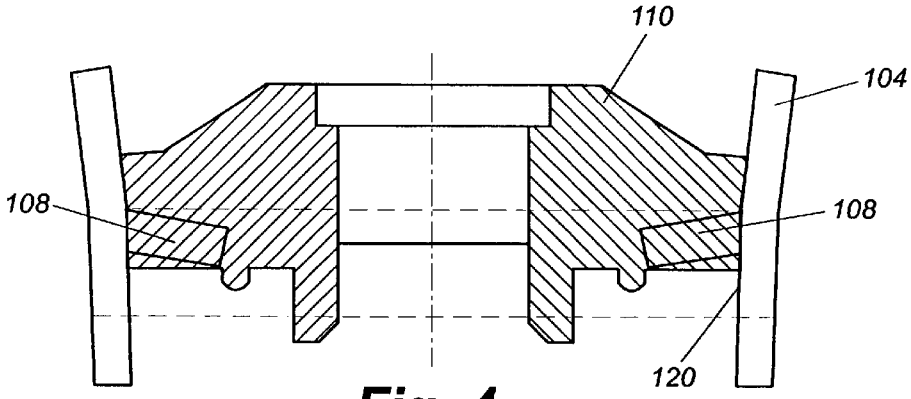
Fig. 4 PRIOR ART
FIGS. 4–5 are cross-sectional views of the Aupac commutator of FIG. 6 illustrating aspects of its formation.
Figure 5:
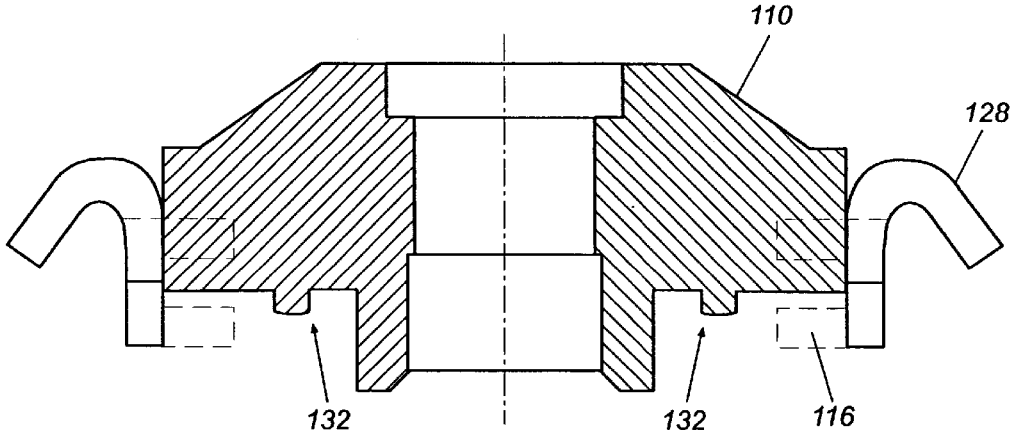
Fig. 5 PRIOR ART
Figure 6:
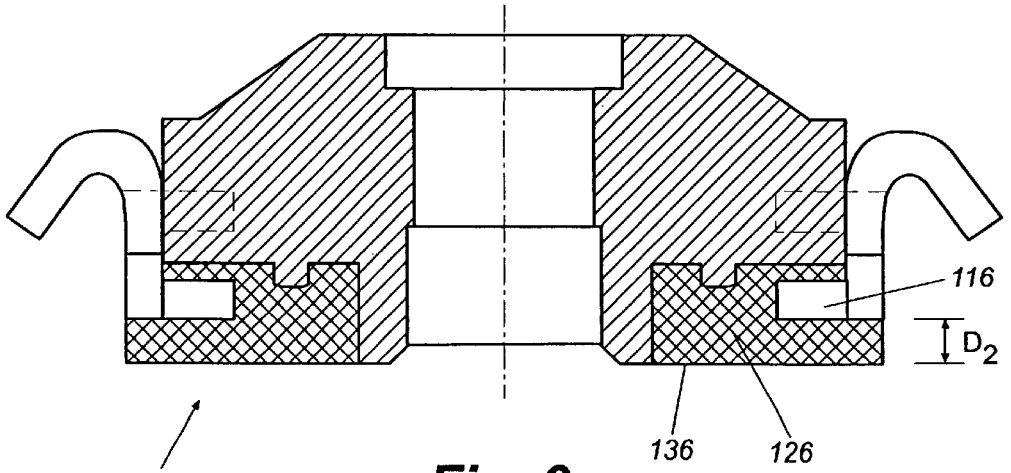
Fig. 6 PRIOR ART
FIG. 6 is a cross-sectional view of the Aupac commutator incorporating the shell of FIG. 1.

As shown in FIG. 7, most or all of the depth $D_1$ of segments 14 is available as a contact surface for the electrical brushes used in conjunction with commutator 10. The useful life of commutator 10 is thus increased over that of the Aupac commutator, as the commutator 10 can continue to operate until surface 18 of each segment 14 is worn substantially the entirety of depth $D_1$. By contrast, only the portions of segments 124 within depth $D_2$ of FIG. 6 are available for contact and wear.

Certain performance aspects of commutator 10 additionally are enhanced through use of the present techniques, as they permit more consistent and higher density molding of preform 50. Because the present invention reduces the likelihood of damage to core 26 as commutator 10 is formed, greater pressure can be used to mold core 26 and pre-form 50. The greater pressure increases the ability of the core 26 to conform to the shape of pre-form 50 and for the two to link together. Greater uniformity of temperature conditioning also is achieved, because the material of core 26 being molded is at approximately the same temperature as the tooling being used and the portion of shell 30 surrounding pre-form 50.

Figure 11:
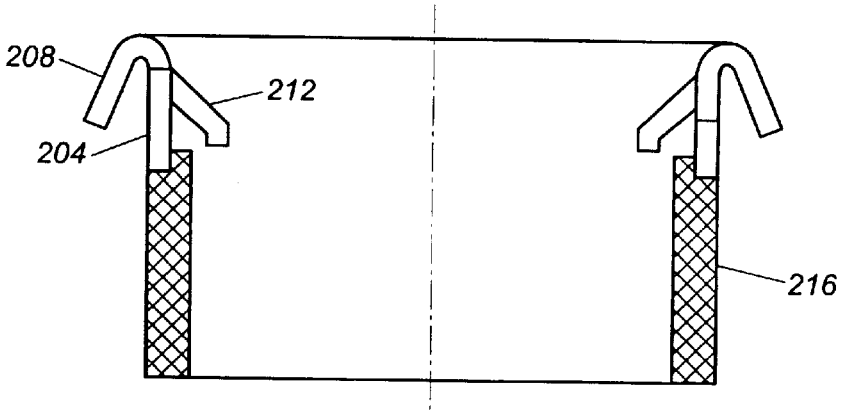
FIGS. 11–12 are cross-sectional view of an alternative, barrel-style commutator made consistent with techniques of the present invention.
Figure 12:
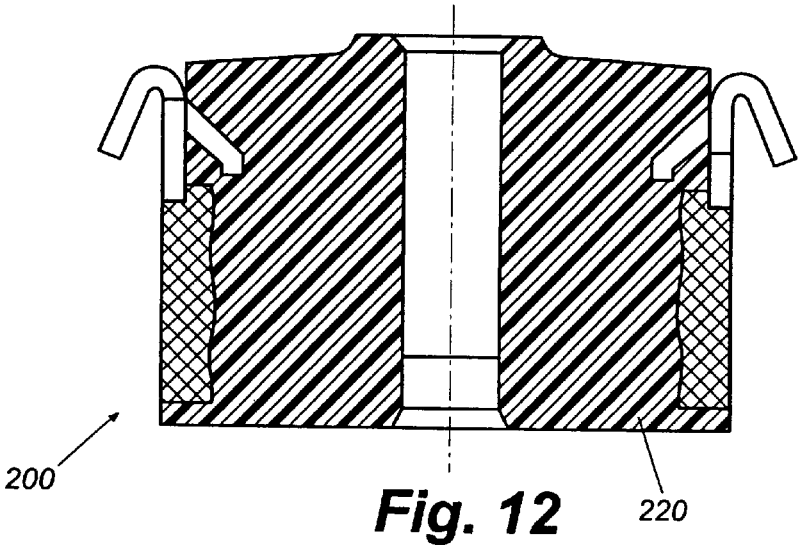

FIGS. 11–12 illustrate a barrel-style commutator 200 according to the present invention. Commutator 200 includes shell 204 from which tangs 208 and anchors 212 are formed. Carbonaceous pre-form 216 can be placed so that shell 204 penetrates it, thereby partially (directly) securing pre-form 216 to shell 204. Core 220 can then be injected within shell 204 and molded onto pre-form 216, with the joint molding of core 220 and pre-form 216 chemically and mechanically interlocking them.

As shown in FIGS. 11–12, anchors 212 are embedded within core 220. If other fixing mechanisms are adequate, anchors 212 need not necessarily be used. Alternatively, anchors 212 (if present) could be repositioned so as to contact pre-form 216 as well.

The foregoing is provided for purposes of illustrating, explaining, and describing embodiments of the present invention. Further modifications and adaptation to these embodiments will be apparent to those skilled in the art and may be made without departing from the scope of spirit of the invention.

We claim:

1. A method of manufacturing a commutator comprising:

a. providing a shell;

b. positioning an electrically-conductive material at least partially within the shell; and c. thereafter simultaneously molding each of an electrically-insulating core and the electrically-conductive material together at least partially within the shell.

2. A method according to claim 1 further comprising curing the core and electrically-conductive material together.

3. A method according to claim 1 further comprising forming a radially-inwardly extending anchor from the shell.

4. A method according to claim 3 in which positioning the electrically-conductive material at least partially within the shell comprises positioning a pre-form in contact with the shell and penetrating the pre-form with the anchor.

5. A method according to claim 4 in which molding the core and the pre-form comprises embedding at least part of the anchor in the core.

6. A method according to claim 5 in which molding the core and the pre-form further comprises chemically bonding the core and pre-form.

7. A method according to claim 6 in which molding the core and the pre-form further comprises mechanically interlocking the core and pre-form.

8. A method according to claim 1 in which the shell has an inner surface and molding the core and the electrically-conductive material together comprises causing the electrically-conductive material to change shape.

9. A method according to claim 1 further comprising shearing the shell so as to expose more completely the electrically-conductive material.

10. A method according to claim 1 further comprising removing a portion of the shell so as to expose more completely the electrically-conductive material.

11. A method of manufacturing a commutator comprising:

a. forming a generally-cylindrical shell having an inner surface and a plurality of anchors extending radially inwardly therefrom, each anchor having a free end;

b. positioning at least partially within the shell an annular electrically-conductive, carbonaceous pre-form having an inner face and an outer face, the inner face being penetrated by the free end of each of the plurality of anchors;

c. thereafter molding an electrically-insulating core onto the pre-form so as to embed within the core portions of the plurality of anchors other than their free ends, such molding:

i. chemically bonding the core and preform;

ii. mechanically interlocking the core and pre-form; and iii. causing the diameter of the pre-form to increase;

d. curing the core and pre-form together; and e. slotting the pre-form to create a plurality of commutator segments, the outer face of the slotted pre-form being adapted to contact at least one electrical brush as the commutator rotates in use.

12. A method of manufacturing a flat-type commutator comprising:

a. providing a shell having an approximate height $A_1$;

b. retaining an electrically-insulating core at least partially within the shell to an approximate depth $A_2$; and c. retaining wholly within the shell an electrically-conductive material having an approximate height $A_3$ and a face adapted for contacting an electrical brush in use so that height $A_1$ is greater than the sum of depth $A_2$ and height $A_3$.

13. A method according to claim 12 further comprising reducing the height of the shell to approximately the sum of depth $A_2$ and height $A_3$.

14. A method of making commutators comprising:

a. placing an electrically-conductive pre-form adjacent an electrically-conductive shell;

b. simultaneously molding each of an electrically non-conductive material and the electrically-conductive pre-form together with the electrically-conductive shell to form an assembly of electrically non-conductive material, electrically-conductive pre-form, and electrically-conductive shell; and c. curing the electrically non-conductive material.

15. A method according to claim 14 in which the step of molding the electrically non-conductive material is done under pressure and urges the electrically-conductive pre-form and electrically-conductive shell together.

16. A method according to claim 15 in which the preform is deformable and deforms during molding to match the contours of part of the electrically-conductive shell.

17. A commutator comprising:

a. a shell;

b. an electrically-conductive material positioned at least partially within the shell and having an inner face and an outer face, the outer face adapted to contact an electrical brush in use; and c. an insulating core simultaneously molded together with the electrically-conductive material so as to be chemically bonded to the inner face.

18. A method of manufacturing a switching device comprising:

a. providing a metallic member;

b. positioning an electrically-conductive material in contact with the metallic member; and c. thereafter simultaneously molding each of an electrically-insulating core and the electrically-conductive material together.

19. A method according to claim 18 in which the metallic member has an inner surface and molding the core and the electrically-conductive material together comprises causing the electrically-conductive material to change shape.

20. A method according to claim 19 in which molding the core and the electrically-conductive material together comprises chemically bonding the core and electrically-conductive material.

21. A method according to claim 18 in which molding the core and the electrically-conductive material together comprises chemically bonding the core and, electrically-conductive material.

* * * * *